US006910946B2

(12) United States Patent
Yoon

(10) Patent No.: US 6,910,946 B2
(45) Date of Patent: Jun. 28, 2005

(54) POLISHING MACHINE

(75) Inventor: Sang-dae Yoon, Kyungsangnam-do (KR)

(73) Assignee: Fineacetechnology Co., Ltd. (KR)

( * ) Notice: Subject to any disclaimer, the term of this patent is extended or adjusted under 35 U.S.C. 154(b) by 11 days.

(21) Appl. No.: 10/487,582

(22) PCT Filed: Mar. 24, 2003

(86) PCT No.: PCT/KR03/00577

§ 371 (c)(1),
(2), (4) Date: Feb. 23, 2004

(87) PCT Pub. No.: WO03/080289

PCT Pub. Date: Oct. 2, 2003

(65) Prior Publication Data

US 2004/0203319 A1 Oct. 14, 2004

(30) Foreign Application Priority Data

Mar. 24, 2002 (KR) ..... 10-2002-0015836

(51) Int. Cl.[7] ..... B49D 1/00

(52) U.S. Cl. ..... 451/8; 451/5; 451/10; 451/11; 451/126; 451/127; 451/150; 451/164; 451/174; 451/177

(58) Field of Search ..... 451/5, 8, 10, 11, 451/126, 127, 150, 164, 166, 174, 177

(56) References Cited

U.S. PATENT DOCUMENTS 4,936,052 A 6/1990 Nagase et al.
5,007,204 A 4/1991 Ibe et al.
5,895,311 A * 4/1999 Shiotani et al. ..... 451/5
6,602,110 B2 * 8/2003 Yi et al. ..... 451/9
6,623,339 B1 * 9/2003 Igarashi et al. ..... 451/42

OTHER PUBLICATIONS

PCT International Search Report; International Application No. PCT/KR03/00577; Date of Mailing: Jun. 24, 2003.

* cited by examiner

*Primary Examiner*—Joseph J. Hail, III
*Assistant Examiner*—Shantese L. McDonald
(74) *Attorney, Agent, or Firm*—Cantor Colburn LLP

(57) ABSTRACT

The polishing machine processes a workpiece put on table of body by four-directional control and is provided with a pair of columns. It comprises: first carrying unit having both ends fixed to pair of columns and having carrying part mounted on upper side; a second carrying unit being fixed to the carrying part in the direction orthogonal to the first carrying unit; third carrying unit being fixed to one end of the second carrying unit in the direction orthogonal to the second carrying unit; a tool head unit being mounted to lower side of the third carrying unit to be inclinable at predetermined angle by a tilting unit rotating at a constant angle and having driving means for rotating a polishing tool mounted at one side; and automatic constant pressure regulating means providing a predetermined virtual pressure with respect to the polishing tool mounted on the tool head unit.

8 Claims, 6 Drawing Sheets

POLISHING MACHINE

TECHNICAL FIELD

The present invention relates to a polishing machine, and more particularly to a polishing machine which is capable of improving the precision of workpiece processing and its reliability by conducting a polishing process using a grinding tool at a constant pressure by means of a static pressure system and controlling the operating system of a tool carrying unit in a more stable manner.

BACKGROUND ART

Generally, a polishing process is used to polish part of the face of a casting in various shapes and patterns such as a mold, a cold forging mold and a blank mold to be as smooth as a mirror.

This polishing process plays the role of minimizing surface roughness after a milling or grinding process in order to make the surface smooth and maintain surface precision.

Equipment such as home appliances and OA (Office Automation) devices tend to have a short life cycle due to more diverse consumer demand, so the demand for molds continually increases. However, the polishing process, which is the final step of the mold manufacturing, is still conducted manually. There is designed a 6-axis multi-joint robot to automate the polishing process. However, the positioning ability of this robot is inferior to a machine tool having X, Y and Z axes, thereby inferior in precision to other finished surfaces.

As an example of the conventional polishing machine, FIG. 1 shows a machine tool having a 3-directional carrying unit. In this polishing machine, a table 3 is rotatably mounted on a main body 1, and a workpiece is fixed on the table 3. An instruction box 5 having various control buttons installed on one side of the main body 1 for controlling the machine. The signal input via the control buttons of the instruction box 5 is transmitted to a control box 7, which is provided on one side of the body and outputs a control signal to various operating units.

In addition, a pair of columns 9 are fixed to the main body 1. A pair of the columns 9 supports a X-axis carrying unit 11 which is used for lateral movement along the X-axis as in FIG. 1. A Y-axis carrying unit 13 is attached to the front side of the X-axis carrying unit 11 in the shape of a cantilever. The Y-axis carrying unit 13 has the same height as the X-axis carrying unit 11, and is used for front or back movement along the Y-direction as shown in FIG. 1.

Moreover, a Z-axis carrying unit 15 used for vertical movement along the Z-axis as in FIG. 1 is attached to one side of the Y-axis carrying unit 13. Below the Z-axis carrying unit 15, a grinding tool holder 19 is mounted so as to be rotatable at a predetermined angle. A grinding tool 17 is fixed to one side of the grinding tool holder 19.

The conventional polishing machine constructed as above is operated as follows.

If a user sends a manipulating signal through the instruction box 5, operating signals are transmitted to the X-, Y- and Z-axis carrying units 11, 13 and 15 respectively through the control box 7, thereby controlling the grinding tool 17 moving it to a desired position.

At the same time, the grinding tool holder 19 rotates at a predetermined angle so that the grinding tool 17 may more precisely contact the workpiece fixed on table 3.

If the compressed air is supplied to the grinding tool holder 19, the polishing process of the workpiece is conducted by rotation of the grinding tool 17.

In the conventional polishing machine having a configuration and operation as above, the X-axis carrying unit 11 and the Y-axis carrying unit 13 are combined in the shape of a cantilever. Thus, the Y-axis carrying unit 13 is apt to be overloaded. In particular, when the polishing process is performed on a corner of a minute curve by means of the grinding tool 17, vibration and noise may be generated.

In addition, the rotation number of the grinding tool 17 should be adjusted according to materials of the tool and the mold. However, since the grinding tool 17 is rotated by the compressed air in the conventional method, the adjustment in the number of rotations of the tool 17 is not accurate, thereby failing to perform adequate polishing work.

Moreover, in conducting the polishing process while the rotating grinding tool 17 is in contact with the surface of the workpiece, there is required to put pressure on the surface of the workpiece at a constant pressure in order to maintain constant finish of the surface. However, since the conventional machine is not equipped with a means to maintain a stable pressure, the work reliability is lower.

DISCLOSURE OF INVENTION

The present invention has been made to overcome the above problems, and it is an object of the present invention to provide a polishing machine which is capable of reducing vibration and noise generated in the polishing process by means of controlling an operation system so that X-, Y- and Z-axis carrying units are operated in a more stable manner.

Another object of the present invention is to provide a polishing machine which is capable of improving processing accuracy and reliability by means of precise control of the number of rotations by the grinding tool, enabling the grinding tool to conduct the polishing process at a constant pressure.

In order to accomplish the above object, there is provided a polishing machine which processes a workpiece put on a table of a main body by means of 4-directional control and has a pair of columns in the main body, the polishing machine comprising: a first carrying unit, both ends of which are fixed to a pair of the columns, the first carrying unit having a carrying block mounted thereon; a second carrying unit horizontally perpendicular to the first carrying unit and fixed to the carrying block; a third carrying unit vertically perpendicular to the second carrying unit and fixed to one end of the second carrying unit; a tool head unit mounted below the third carrying unit and inclined at a predetermined angle by a tilting unit for providing a rotational movement at a predetermined angle thereto, the tool head unit having a driving unit for rotating a grinding tool mounted to one side thereof; and a pressure adjustment unit for providing constant pressure to the grinding tool mounted to the tool head unit so that the grinding tool is in contact with the workpiece.

According to an aspect of the present invention, there is provided a polishing machine including a main body having a table on which a workpiece is fixed, and a tool head unit for enabling X-, Y- and Z-axis directional movements of a grinding tool for processing the workpiece on the table and capable of tilting it at a predetermined angle, the polishing machine comprising: a first carrying unit including a first housing both ends of which are fixed to each upper pair of columns, two guide rails installed on both edges of an upper surface of the first housing, a servo motor mounted to the one end of the first housing, and a ball screw rotating according to the operation of the servo motor; a carrying block mounted on the first housing to be slidable along the guide rail, the carrying block moving the tool head unit in X-axis direction by means of the ball screw; a second carrying unit fixed to an upper portion of the carrying block through a fixing plate, the second carrying unit having a driving source therein for enabling Y-axis directional movement of the tool head unit; a third carrying unit arranged vertically perpendicular to the second carrying unit and including a third housing having a driving source for enabling Z-axis directional movement of the tool head unit and an elongated portion extending downward from a lower end of the third housing; a tilting unit mounted to a lower end of the elongated portion of the third carrying unit for tilting the tool head unit to a predetermined angle; a driving unit for rotating the grinding tool mounted to the tool head unit; and a pressure adjustment unit for providing constant pressure to the grinding tool so that the grinding tool is in constant contact with the workpiece.

BRIEF DESCRIPTION OF THE DRAWINGS

These and other features, aspects, and advantages of preferred embodiments of the present invention will be more fully described in the following detailed description, taken accompanying drawings. In the drawings.

BEST MODES FOR CARRYING OUT THE INVENTION

Hereinafter, preferred embodiments of the present invention will be described in detail with reference to the accompanying drawings.

Figure 1:
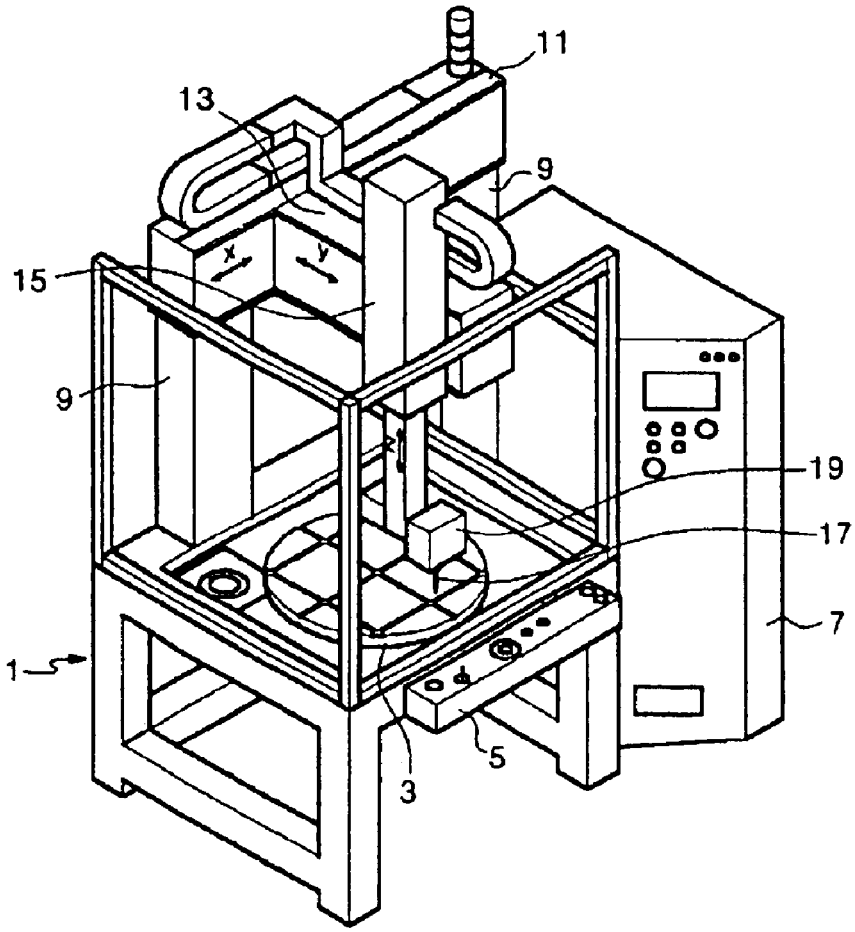
FIG. 1 is a perspective view showing a conventional polishing machine.
Figure 2:
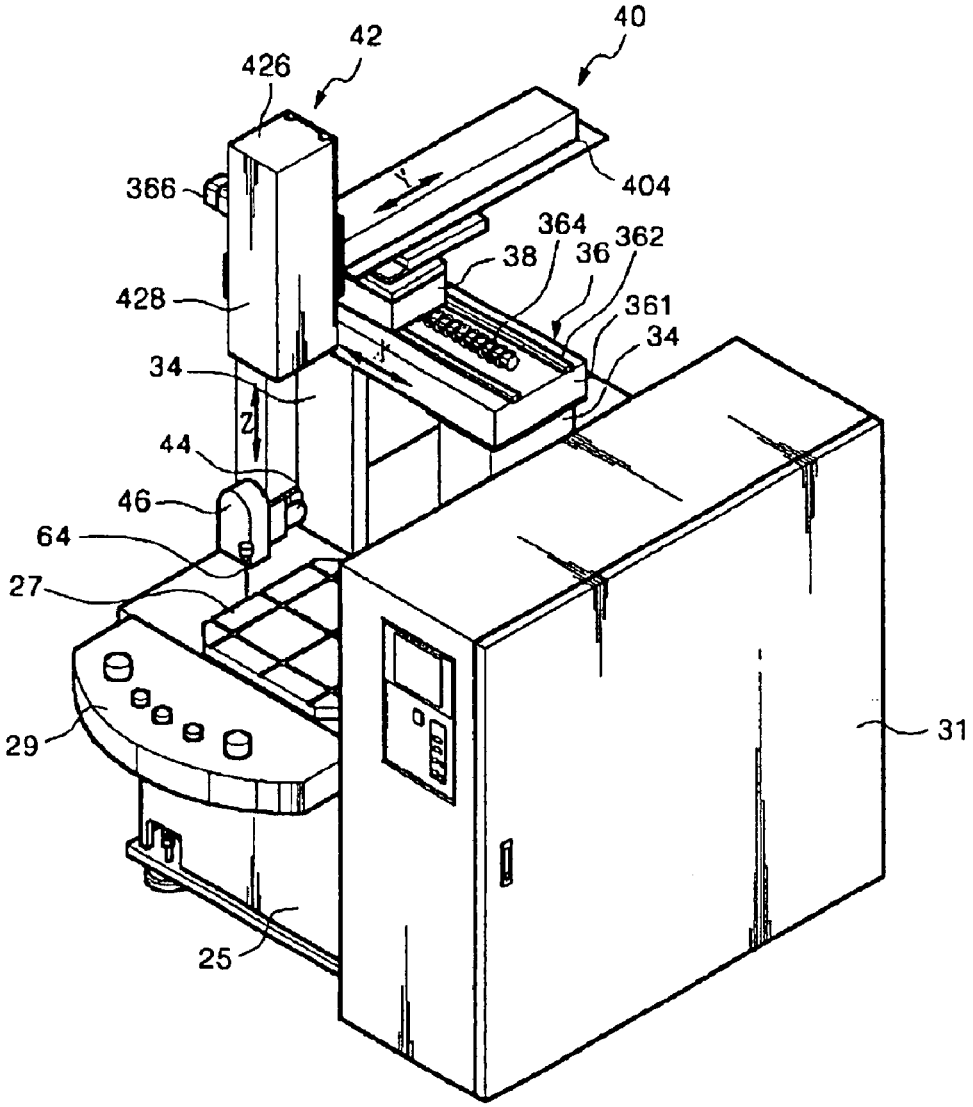
FIG. 2 is a perspective view showing a polishing machine according to a preferred embodiment of the present invention.

At first, as shown in FIG. 2, a polishing machine according to a preferred embodiment of the present invention includes a main body 25 configuring a support part and a table 27 mounted to the main body 25 to be rotated at a predetermined angle. A workpiece is fixed on the table 27.

In addition, in the main body 25, a control unit 29 having various operation switches and buttons manipulated by a user for controlling overall operation of the machine and a control box 31 for receiving a signal from the control unit 29 and outputting a control signal to various operating units are equipped.

A pair of columns 34 having a rectangular bar shape is fixed to both sides of the main body 25. Above the columns 34, a first carrying unit 36, a carrying block 38 and a second carrying unit 40 are arranged in order.

The first carrying unit 36 for providing the X-axis direction movement of a tool head unit 46 includes a first housing 361 both ends of which are fixed to upper end of a pair of the columns 34, two guide rails 362 mounted at both edges of the upper surface of the first housing 361, a servo motor 366 mounted at one end of the first housing 361, and a ball screw 364 rotated by the servo motor 366 to carry the carrying block 38 in the X-axis direction. Thus, if the ball screw 364 rotates by the servo motor 366, the carrying block 38 on the housing 361 moves in the X-axis direction by means of the ball screw 364. As a result, it is possible to regulate the position of the X-axis of the tool head unit 46 relative to a workpiece on the table 27. At this time, the movement of the carrying block 38 is guided along the guide rails 362.

On the other hand, the second carrying unit 40 for moving the tool head unit 46 in Y-axis direction includes a second housing 404 fixed to an upper portion of the carrying block 38 through a fixing plate 382. In addition, though not shown in the figure, a ball screw similar to the ball screw 364 of the first carrying unit 36 is mounted below the second housing 404, and a driving unit for rotating the ball screw like the servo motor 366 of the first carrying unit 36 is equipped in the second housing 404 in order to regulate the Y-axis directional movement of the tool head unit 46. Thus, the second carrying unit 40 may regulate the Y-axis directional position of the tool head unit 46 against the workpiece on the table 27.

A third housing 426 configuring a third carrying unit 42 is mounted to one side of the second carrying unit 40. Though not shown in the figure, a ball screw similar to the ball screw 364 of the first carrying unit 36 is mounted below the third housing 426, and a driving unit for rotating the ball screw like the servo motor 366 of the first carrying unit 36 is equipped in the third housing 426 in order to regulate the Z-axis directional movement of the tool head unit 46. Thus, the second carrying unit 40 may regulate the Z-axis directional position of a grinding tool 64 against the workpiece on the table 27.

Figure 5:
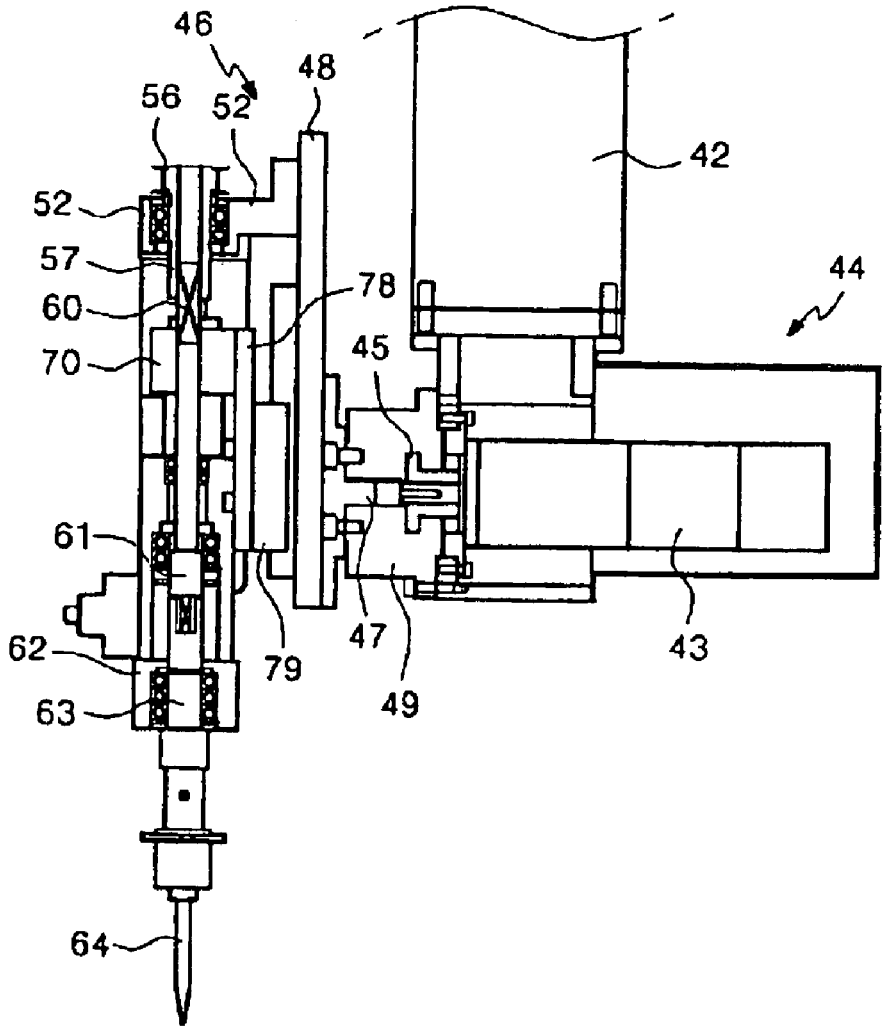
FIG. 5 is a sectional view showing an installed state of the tool head unit according to the preferred embodiment of the present invention.

As shown in FIG. 5, a tilting unit 44 for tilting the grinding tool 64 relative to the workpiece is mounted at a lower end of an elongated portion 428 which is elongated downward from a lower end of the third housing 426. The tilting unit 44 has a tilting servo motor 43 for driving the tool head unit 46 through a driving axis 45 and a driven axis 47. The driven axis 47 engaged with the driving axis 45 is fixed to the base 48 of the tool head unit 46. This driven axis 47 transmits the rotational force of the tilting servo motor 43 supplied through the driving axis 45 toward the tool head unit 46 so that the grinding tool 64 mounted at the lower end of the tool head unit 46 may be tilted.

The driven axis 47 is mounted to one side of the base 48 fixed to one side of the tilting unit 44 through a connection block 49. The tool head unit 46 is mounted to the other side of the base 48.

Figure 3:
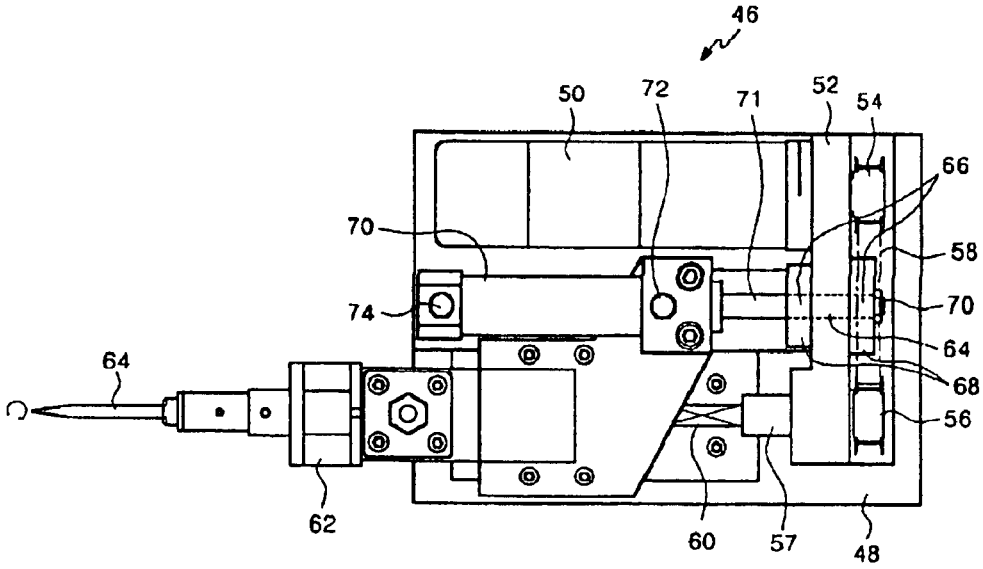
FIG. 3 is a front view showing a tool head unit according to a preferred embodiment of the present invention.
Figure 4:
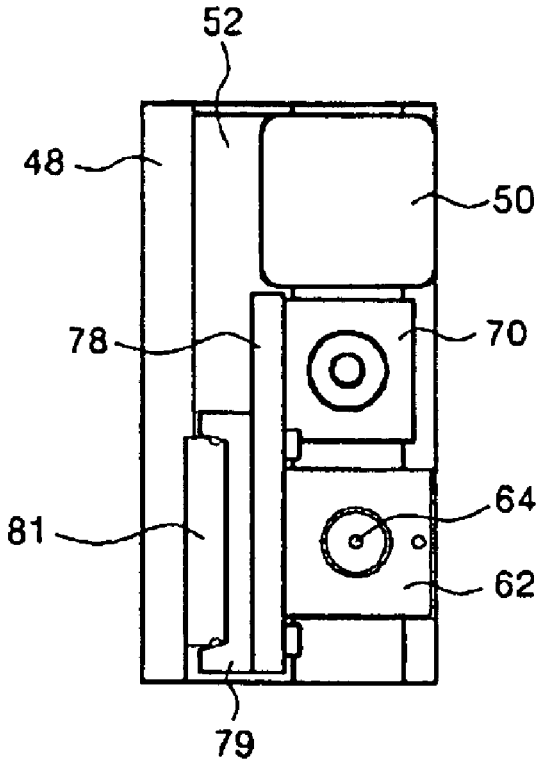
FIG. 4 is a side view showing the tool head unit according to the preferred embodiment of the present invention.

As shown in FIGS. 3 and 4, the tool head unit 46 is provided with a tool-rotating servo motor 50 for rotating the grinding tool 46. One end of this servo motor 50 is fixed to one side of a fixing bracket 52. A driving pulley 54 mounted to a rotary shaft of the servo motor 50 is positioned to the other side of the fixing bracket 52 fixed to the base 48.

In addition, a driven pulley 56 is positioned to the other side of the fixing bracket 52, being spaced apart form the driving pulley 54. The driving pulley 54 and the driven pulley 56 are wound by a belt 58. Thus, the rotational force of the servo motor 50 is transmitted to the driven pulley 56 through the driving pulley 54 and the belt 58.

A connection rod 57 is mounted to the other side of the fixing bracket 52. The rotational force of the driven pulley 56 is transmitted to the grinding tool 64 through a rectangular spindle 60. As shown in FIG. 5, the connection rod 57 has a rectangular groove which one end of the rectangular spindle 60 having a rectangular section is inserted into. Thus, the rectangular spindle 60 is capable of transmitting the rotational force from the servo motor 50 and at the same time is capable of sliding in a longitudinal direction along an inner surface of the connection rod 57.

The rotational force of the driven pulley 56 transmitted through the rectangular spindle 60 is then transmitted to a rotary shaft 63 through a connection portion 61. The connection portion 61 has rectangular grooves at both sides, respectively. Among them, one end of the spindle 60 is inserted into the rectangular groove formed on one end of the connection portion 61, while one end of the rotary shaft 63 is inserted into the rectangular groove formed on the other end. The grinding tool 64 is coupled to the lower end of the rotary shaft 63. As described above, since the connection portion 61 has the rectangular grooves at both ends, the spindle 60 and the rotary shaft 63 coupled to both ends of the connection portion 61 can transmit the rotational force from the servo motor 50 and at the same time can slide in a longitudinal direction along the inner surface of the connection portion 61.

In such a configuration, if the rotary shaft 63 rotates by the rotational force transmitted from the servo motor 50 through the driving pulley 54, the belt 58, the driven pulley 56, the connection rod 57 and the connection portion 61, the grinding tool 64 coupled to the lower end of the rotary shaft 63 also rotates and conducts the polishing process for the workpiece fixed on the table 32.

On the other hand, as shown in FIG. 3, a through hole 64 is formed in the center of the fixing bracket 52. To both sides of the through hole 64, attached is a hollow plate 68 of a disk shape having a threaded fixing hole 66 at its center.

A screw is also formed on a piston rod 71 of an air cylinder 70 so as to correspond to the threaded fixing hole 66. During assembling, the piston rod 71 of the air cylinder 70 passes through the fixing hole 66 of the hollow plate and the through hole 64 of the bracket, and is then fixed by a nut 70 screwed to the threaded portion.

Figure 6:
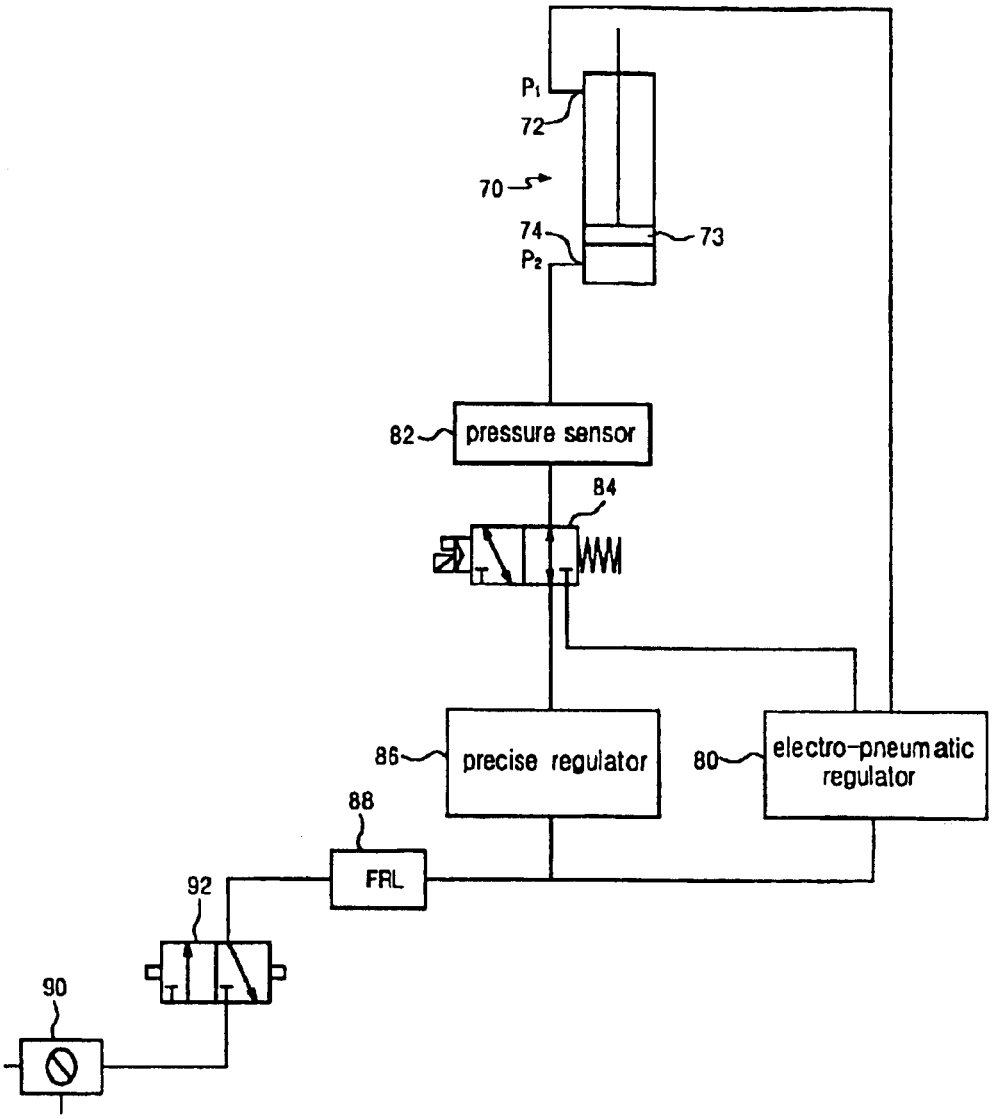
FIG. 6 shows a pneumatic circuitry of a pressure adjustment unit according to the preferred embodiment of the present invention.

The air cylinder 70 is a double-acting cylinder. As shown in FIG. 6, the air cylinder 70 includes a first port 72 and a second port 74 provided at both ends for introducing the compressed air from a pneumatic source 90. Thus, the inside of the air cylinder 70 may is balanced to have a static pressure by using the compressed air supplied to the second port 74 and the first port 72.

The air cylinder 70 has a piston 73 for sliding along its inner wall. The piston 73 is connected to a piston rod 71. In addition, the pressing force of the grinding tool 64 exerted to the workpiece on the table 27 may change during the polishing process. At this time, the changed pressing force is transmitted to the fixing bracket 52 through the rotary shaft 63, the connection portion 61 and the connection rod 57. Therefore, the fixing bracket 52 moves forward and backward, and the piston rod 71 connected to the fixing bracket 52 also moves forward and backward, thereby moving the position of the piston 73 and changing the pressure in the air cylinder 70.

Here, the pressure change in the air cylinder 70 may be detected and controlled using a pressure adjustment unit to be described later with reference to FIG. 6. Therefore, it becomes possible to always keep a constant pressing force of the grinding tool 64 against the workpiece on the table 27.

On the other hand, as shown in FIG. 4, a spindle head 62 and the air cylinder 70 are fixed to a plate 78, which is fixed to an LM guide 79. This LM guide 79 is mounted to be slidable along a guide rail 81 fixed to the base 48. Thus, as described later in detail, if the piston rod 71 moves forward or backward by the operation of the pressure adjustment unit, the LM guide 79 of the plate 78 in which the air cylinder 70 and the spindle head 62 are mounted slides on the guide rail 81 of the base 48, thereby keeping the pressing force of the grinding tool 64 against the workpiece on the table 27 regularly.

The air cylinder 70 is provided with the pressure adjustment unit as shown in FIG. 6. The conduit connected to the first port 72 of the air cylinder 70 is connected to an electro-pneumatic regulator 80, while the conduit connected to the second port 74 is subsequently connected to a pressure sensor 82 for detecting pressure and to a first solenoid valve 84 for controlling the direction of the compressed air.

The conduit getting out of the first solenoid valve 84 is diverged into two conduits. One of them is connected to the electro-pneumatic regulator 80, and the other is connected to a precise regulator 86.

The conduits for providing compressed air to the precise regulator 86 and the electro-pneumatic regulator 80 are connected to an air unit (FRL) 88, which is an assembly of an air filter, a regulator and a lubricator. Between the air unit 88 and the pneumatic source 90, a second solenoid valve 92 is connected.

The pressure sensor 82 detects pressure in the conduit and transmits the detected value to a control unit (not shown) in the control box 31. The control unit compares the value transmitted from the pressure sensor 82 with a set value and then sends a control signal to the electro-pneumatic regulator 80 and the first solenoid valve 84 to control the air pressure supplied to the air cylinder 70.

Here, the precise regulator 86 preferably employs a regulator capable of adjusting the pressure into 3 stages, thereby controlling the air pressure more accurately than general regulators.

In the preferred embodiment of the present invention, the electro-pneumatic regulator 80 and the precise regulator 86, which are used as a pressure adjustment unit, the pressure sensor 82 and the air unit 88 are well known to those skilled in the art, and not described here in detail.

Now, the operation of the polishing machine according to the preferred embodiment of the present invention constructed as above is described.

For the movement of the tool head unit 46 in the X-, Y- and Z-axis directions, a worker operates the operation switches and the operation buttons installed in the control unit 29. Then, the control unit of the control box 31 outputs control signals to the first to third carrying units 36, 40 and 42 on the basis of the input signal.

By use of the signal from the control unit, the servo motor 386 of the first carrying unit 36 starts to move. Then, the ball screw 364 rotates and the carrying block 38 moves in the X-axis direction along the guide rail 362. Therefore, the tool head unit 46 moves in the X-axis direction.

On the other hand, if a control signal for Y-axis directional movement of the tool head unit 46 is transmitted to the driving source mounted in the second carrying unit 40, the second carrying unit 40 moves in a direction (Y-axis direction) perpendicular to the first carrying unit 36, thereby moving the tool head unit 46 in the Y-axis direction.

In addition, if a control signal for Z-axis directional movement of the tool head unit 46 is transmitted to the driving source mounted in the third carrying unit 42, the third housing 426 of the third carrying unit 40 moves vertically, thereby moving the tool head unit 46 in the Z-axis direction.

On the other hand, if a tilting signal of the tool head unit 46 is input, the control unit outputs a control signal to the tilting servo motor 43 included in the tilting unit 44 shown in FIG. 5. If the tilting servo motor 43 rotates the driving axis 45, the driven axis 47 fixed to the base 48 also rotates together, thereby rotating the tool head unit 46 at a certain angle. Therefore, it is made possible to tilt the grinding tool 64 against the workpiece on the table 27.

Afterwards, if a worker pushes an operation switch for rotation of the grinding tool 64, the control unit in the control box 31 outputs a control signal to the tool-rotating servo motor 50 shown in FIG. 4. If the servo motor 50 rotates the driving pulley 54 according to the electric connection of the servo motor 50, the rotation of the driving pulley 54 is transmitted to the driven pulley 56 through the belt 58, and the rotation of the driven pulley 56 is transmitted to the rectangular spindle 60 through the connection rod 57, thereby rotating the rectangular spindle 60.

The rotation of the rectangular spindle 60 is also transmitted to the tool-fixing rotary shaft 63 coupled to the connection portion 61 as shown in FIG. 5, thereby rotating the grinding tool 64 mounted to the lower end of the tool-fixing rotary shaft 63. Therefore, the grinding tool 64 may execute the polishing process to the workpiece on the table 27.

At this time, in case of adjusting the rotation speed of the grinding tool 64, the rotation speed of the grinding tool 64 is controlled more simply and accurately by adjusting the rotation speed of the tool-rotating servo motor 50.

In addition, in the pressure adjustment unit using the air cylinder 70, as shown in FIG. 6, the compressed air generated by the pneumatic source 90 is supplied to the air unit 88 through the second solenoid valve 92. The air flowed in the air unit 88 becomes static and is kept constant.

The compressed air having a certain pressure passing from the air unit 88 is respectively supplied to the precise regulator 86 and the electro-pneumatic regulator 80, respectively. At this time, the compressed air supplied to the 3-stage type precise regulator 86 is adjusted more precisely in three stages, and then supplied to the second port 74 of the air cylinder 70 through the first solenoid valve 84. In addition, the compressed air supplied from the air unit 88 to the electro-pneumatic regulator 80 is supplied to the first port 72 of the air cylinder 70 in a regular pressure.

Therefore, the inside of the air cylinder 70 is balanced to have a static pressure by the compressed air supplied to the second port 74 and the first port 72. At this time, if the piston rod 71 in the air cylinder moves forward or backward according to the procedure of the polishing process, the piston 73 connected to the piston rod 71 slides along the inner wall of the air cylinder 70, thereby changing the air pressure in the air cylinder 70.

At this time, since the pressure sensor 82 is installed in the conduit between the first solenoid valve 84 and the second port 74 of the air cylinder 70, a signal regarding the air pressure change on the conduit detected by the pressure sensor 82 is directly transmitted to the control unit of the control box 31.

The control unit compares the input signal transmitted from the pressure sensor 82 with a set value, and then outputs a control signal to the electro-pneumatic regulator 80 when the detected pressure is different from the set value. Therefore, the electro-pneumatic regulator 80 controls the pressure supplied to the air cylinder 70 through the second port 74 so as to always keep the pressure of the air cylinder 70 regularly.

In an exemplified explanation, if the air pressure having a value of 1 is supplied to the first port 72 and the second port 74, the piston 73 of the air cylinder 70 moves backward to reduce the inner space of the air cylinder 70 connected to the second air port 74, thereby relatively increasing the air pressure.

For example, the air pressure increases to 1.3, the pressure sensor 82 detects it and sends a signal to the electro-pneumatic regulator 80, and the air pressure established in the electro-pneumatic regulator 80 is supplied to the second port 74, thereby moving the piston 73 of the air cylinder 70 into its initial position.

At this time, the compressed air supplied to the second port 74 has a value of 1.6 greater than the increased pressure, i.e., 1.3. If the pressure of the second port 74 decreases, a lower pressure is supplied to the second port 74, thereby moving the piston 73 to its initial position.

The air cylinder 70 equipped with the above-mentioned pressure adjustment unit works together with the grinding tool 64 fixed to one side of the fixing bracket 52 since the piston rod 71 having a screw portion is fixed to the fixing bracket 52 by means of the nut 70, as shown in FIGS. 3 and 4.

During the polishing process, the grinding tool 64 is pressed into the workpiece by about 10 mm. If the grinding tool 64 is pressed more than a set value or less than a set value due to the shape of the workpiece, the rectangular spindle 60 fixed to and working together with the grinding tool 64 slides in the connection rod 57.

The tool-fixing rotary shaft 63 coupled to the grinding tool 64 is fixed in the spindle head 62, and the air cylinder 70 also works together and moves along the LM guide 79, being mounted to the plate 78.

The operation of the air cylinder 70 activates the pressure adjustment unit according to the preferred embodiment of the present invention, thereby moving the piston rod 71 forward or backward.

Accordingly, the plate 78 to which the air cylinder 70 and the spindle head 62 are mounted slides along the LM guide 79, so the grinding tool 64 polishes the workpiece fixed to the table 27 at a constant pressure.

The polishing machine according to the preferred embodiment of the present invention constructed as above can prevent any member from being overloaded since the first carrying unit 36 and the second carrying unit 40 are coupled in a shape of not a cantilever but a simple beam. In addition, the polishing machine gives more precise circumstances in the polishing process since vibration and noise are decreased.

In addition, though the grinding tool 64 is conventionally rotated using the compressed air, the present invention adopts the tool-rotating servo motor 50, thereby enabling more accurate control of the rotation number.

Moreover, by using the rectangular spindle 60 which is capable of receiving a rotational force while being capable of sliding in the connection rod 57, the polishing machine of the present invention gives a power transmission structure having increased free degrees, while receiving the rotational force more easily.

In addition, since the pressure adjustment unit is provided so that the grinding tool 64 may be contacted to the workpiece with a constant pressure, the polishing process may be accomplished more regularly.

INDUSTRIAL APPLICABILITY

As described above, by using the polishing machine of the present invention, it is possible to give a system which operates with more stable coupling structure between orthogonal carrying units, thereby ensuring a more precise polishing process.

In addition, since the grinding tool is driven using a motor, the rotation number of the grinding tool can be adjusted depending on working conditions, thereby improving the work efficiency.

Moreover, since the pressure adjustment unit is provided so that the grinding tool can be contacted to the workpiece at a constant pressure, the work reliability is more improved.

What is claimed is:

1. A polishing machine which processes a workpiece put on a table of a main body by means of 4-directional control and has a pair of columns in the main body, the polishing machine comprising:

a first carrying unit both ends of which are respectively fixed to a pair of the columns, the first carrying unit having a carrying block mounted thereon;

a second carrying unit horizontally perpendicular to the first carrying unit and fixed to the carrying block;

a third carrying unit vertically perpendicular to the second carrying unit and fixed to one end of the second carrying unit;

a tool head unit mounted below the third carrying unit and inclined at a predetermined angle by a tilting unit for providing a rotational movement at a predetermined angle thereto, the tool head unit having a driving unit for rotating a grinding tool mounted to one side thereof; and a pressure adjustment unit for providing a constant pressure to the grinding tool mounted to the tool head unit so that the grinding tool is contacted to the workpiece.

2. The polishing machine according to claim 1, wherein the driving unit mounted to the tool head unit includes:

a tool-rotating servo motor;

a driving pulley connected to a rotary shaft of the tool-rotating servo motor;

a driven pulley connected to the driving pulley by means of a belt; and a rectangular spindle one end of which is inserted into one side of the driven pulley, the grinding tool being mounted to the other end of the rectangular spindle.

3. The polishing machine according to claim 1, wherein the pressure adjustment unit includes:

an air cylinder for working together with the grinding tool;

a pressure sensor for detecting a pressure change in the air cylinder;

an electro-pneumatic regulator having at least two set values for giving a compensated pressure so that the air cylinder moves to an initial position in accordance with the detected signal of the pressure sensor; and an air unit having a general regulator and connected to a pneumatic source for supplying an initially established pressure to the air cylinder and the electro-pneumatic regulator.

4. The polishing machine according to claim 3, wherein the pressure adjustment unit further includes a precise regulator having at least two regulators installed in a conduit connected through the air unit to the air cylinder so as to provide air pressure in more static state to the air cylinder.

5. The polishing machine according to claim 3, wherein the pressure adjustment unit further includes a precise regulator having at least two regulators installed in a conduit connected through the air unit to the air cylinder so as to provide air pressure in more static state to the air cylinder.

6. A polishing machine including a main body having a table on which a workpiece is fixed, and a tool head unit for enabling X-, Y- and Z-axis directional movements of a grinding tool for processing the workpiece on the table and capable of tilting at a predetermined angle, the polishing machine comprising:

a first carrying unit including a first housing both ends of which are respectively fixed to each upper end of a pair of columns, two guide rails installed on both edges of an upper surface of the first housing, a servo motor mounted to the one end of the first housing, and a ball screw rotating according to the operation of the servo motor;

a carrying block mounted upon the first housing to be slidable along the guide rail, the carrying block moving the tool head unit in X-axis direction by means of the ball screw;

a second carrying unit fixed to an upper portion of the carrying block through a fixing plate, the second carrying unit having a driving source therein for enabling Y-axis directional movement of the tool head unit;

a third carrying unit arranged vertically perpendicular to the second carrying unit and including a third housing having a driving source for enabling Z-axis directional movement of the tool head unit and an elongated portion elongated downward from a lower end of the third housing;

a tilting unit mounted to a lower end of the elongated portion of the third carrying unit for tilting the tool head unit to a predetermined angle;

a driving unit for rotating the grinding tool mounted to the tool head unit; and a pressure adjustment unit for providing a constant pressure to the grinding tool so that the grinding tool is contacted to the workpiece.

7. The polishing machine according to claim 6, wherein the driving unit mounted to the tool head unit includes:

a tool-rotating servo motor;

a driving pulley connected to a rotary shaft of the tool-rotating servo motor;

a driven pulley connected to the driving pulley by means of a belt; and a rectangular spindle one end of which is inserted into one side of the driven pulley, the grinding tool being mounted to the other end of the rectangular spindle.

8. The polishing machine according to claim 6, wherein the pressure adjustment unit includes:

an air cylinder for working together with the grinding tool;

a pressure sensor for detecting a pressure change in the air cylinder;

an electro-pneumatic regulator having at least two set values for giving a compensated pressure so that the air cylinder moves to an initial position in accordance with the detected signal of the pressure sensor; and an air unit having a general regulator and connected to a pneumatic source for supplying an initially established pressure to the air cylinder and the electro-pneumatic regulator.

* * * * *